US005749623A

United States Patent [19]

Mistry et al.

[11] Patent Number: 5,749,623

[45] Date of Patent: May 12, 1998

[54] REVERSIBLE SWING WITH STORAGE CABINETS

[76] Inventors: Thakor R. Mistry; Jyotsna T. Mistry, both of 9000 Cheltenham Dr., Brandywine, Md. 20613

[21] Appl. No.: 789,135

[22] Filed: Jan. 28, 1997

[51] Int. Cl.[6] ..... A47D 13/10

[52] U.S. Cl. ..... 297/281; 297/9; 297/273; 297/188.08; 5/130; 5/101; 312/107

[58] Field of Search ..... 297/7, 9, 10, 188.01, 297/188.08, 188.11, 273, 274, 281, 92, 94; 5/127, 130, 101; 312/107, 237, 108

[56] References Cited

U.S. PATENT DOCUMENTS

| | | | |
|---|---|---|---|
| D. 24,005 | 2/1895 | Woods | 297/188.08 X |
| D. 264,655 | 6/1982 | Keller | D6/164 |
| D. 305,584 | 1/1990 | Spirlman et al. | 297/273 X |
| 522,783 | 9/1894 | Dewey | 5/101 X |
| 576,603 | 2/1897 | McMordie | 297/273 X |
| 834,988 | 11/1906 | Mallory | 297/188.08 X |
| 992,602 | 5/1911 | Russell | 5/101 |
| 2,398,384 | 4/1946 | Meyers | 297/273 X |
| 2,665,744 | 1/1954 | Hodgson . | |

*Primary Examiner*—Laurie K. Cranmer

*Attorney, Agent, or Firm*—Papan Devani; Thomas A. Powers; Chandrakant C. Shroff

[57] ABSTRACT

An article of furniture comprising:

a) a support frame comprising two hollow vertical supports and a horizontal strut connecting the upper end of the first vertical support to the upper end of the second vertical support;

b) a bench comprising a horizontal support member, a plurality of arm rests mounted on said support member, a seat back, and a means for pivotably mounting said seat back to said plurality of arm rests; and c) a means for suspending the bench from the horizontal strut;

wherein the interior of the vertical supports is accessible through doors provided in the vertical supports.

13 Claims, 4 Drawing Sheets

REVERSIBLE SWING WITH STORAGE CABINETS

FIELD OF THE INVENTION

The present invention relates to swings. More particularly, it relates to swings having reversible seat backs and storage compartments.

BACKGROUND OF THE INVENTION

Benches having reversible seat backs have been known for more than a century. Such benches are typically mounted in railroad cars, and comprise a planar support structure rigidly mounted to the floor of the car by means of a set of legs. Armrests are rigidly mounted to the planar support structure, and a seat back is pivotably mounted to pivot points on the armrests. When the direction of travel of the railroad car changes, the direction faced by the seat may be changed by rotating the seat back about the pivot points on the armrests.

Similar benches having reversible backs which may be suspended from a support structure and used as a swing are also known. It is possible to divide the pivotably mounted back into two sections longitudinally, providing an upper back and a lower back. The upper and lower back sections are independently pivotably mounted to the armrests. By rotating both back sections relative to the armrests, the direction faced by the seat may be changed. By rotating only the upper back section, a crib enclosed on each end by an armrest and on each side by a back section is obtained.

The first object of this invention is to provide a swinging bench having a reversible back, said bench being supported by a sturdy frame which also provides storage space for books, knick-knacks, and other small articles.

The second object of this invention is to provide a swinging crib which may be readily converted to a swinging bench, said crib being supported by a sturdy frame which also provides storage space for toys or other items suitable for an infant.

SUMMARY OF THE INVENTION

The article of furniture disclosed in this invention is a swinging bench suspended from a support. The support comprises a first vertical support, a second vertical support, and a horizontal strut connecting the upper end of the first upright support to the upper end of the second upright support. The vertical supports are hollow, and doors in the vertical supports provide access to the interior of the vertical supports. Shelves may be provided inside the vertical supports for storage of small articles.

A bench is suspended from the horizontal strut from a chain. The bench comprises a horizontal support member and at least two arm rests mounted on the support member. A seat back is pivotably mounted on the arm rests. The direction faced by the seat may be changed by pivoting the seat back relative to the arm rests.

Alternatively, a crib may be suspended from the horizontal strut. The crib comprises a rectangular bottom and two vertical end pieces rigidly mounted to opposite ends of the crib bottom. Two side pieces are pivotably mounted to the end pieces, with each side piece resting on a different side of the crib bottom. By pivoting one of the side pieces relative to the end pieces, the crib may be converted to a bench.

DETAILED DESCRIPTION

Figure 1:
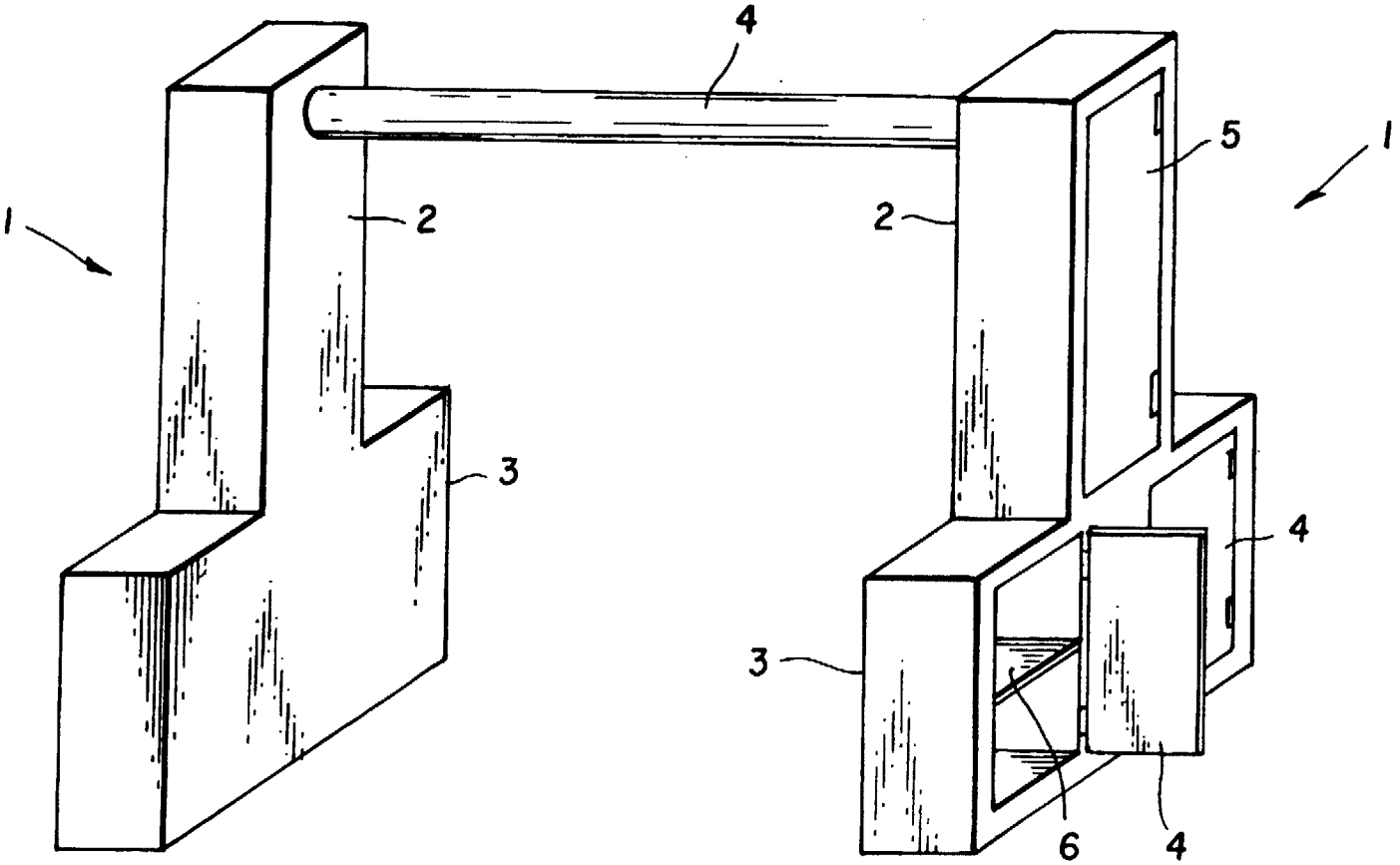
FIG. 1 illustrates the support framework for a first embodiment of the reversible swing described herein.

As shown in FIG. 1, the support framework for the swinging bench is made from two vertical supports 1 connected by a horizontal strut 1*a*. The support framework is preferably made from wood. Each vertical support comprises a narrow upper section 2 and a wide lower section 3. Preferably, sections 2 and 3 have substantially similar depths. At least one of sections 2 and 3 is hollow, and the interior of the hollow section may be accessed through one or more doors in the front of the vertical supports. For example, if the interior of section 2 is hollow, the interior of section 2 may be accessed through door 5. If the interior of section 3 is hollow, the interior of section 3 may be accessed through doors 4. If desired, shelves 6 may be positioned in the hollow regions of the vertical support accessed through doors 4 and 5. Small items such as books, silverware, or knick-knacks may be positioned on shelves 6. Doors 4 and 5 may be constructed from solid wood, or they may be constructed with transparent glass or plastic panels. Doors with transparent panels are desirable, as they allow the interior of the vertical support to be viewed through the doors. Electric lights may be mounted above the shelves inside the vertical support to illuminate articles placed on the shelves.

Figure 2:
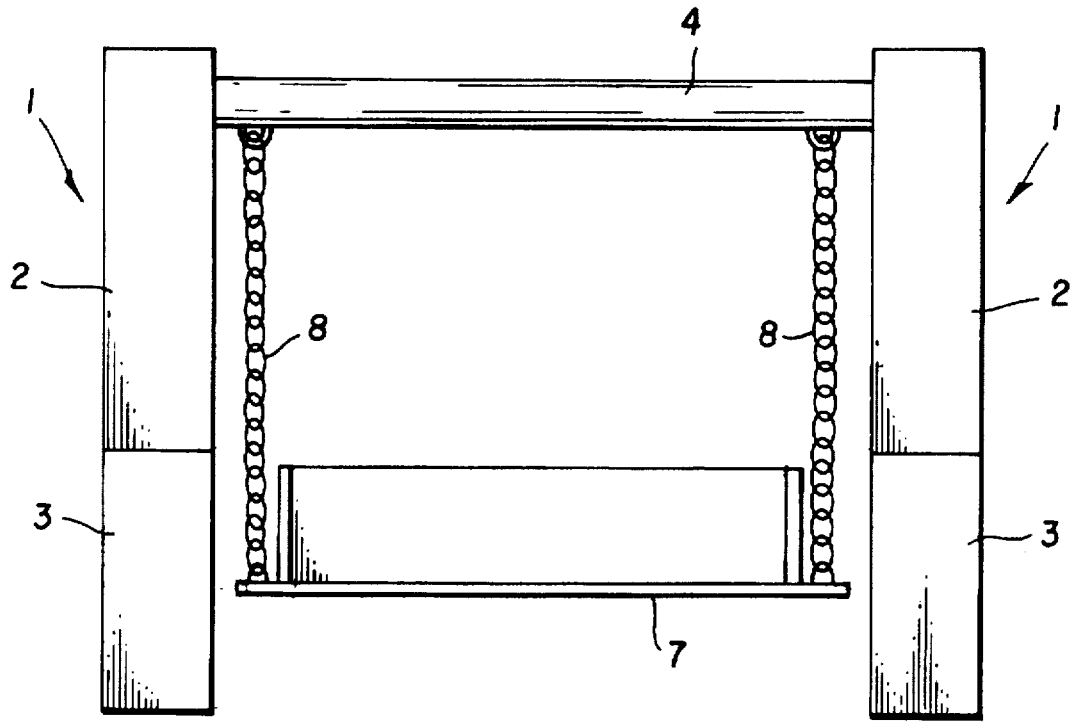
FIG. 2 illustrates a reversible swing comprising a bench suspended from the support framework of FIG. 1.

As shown in FIG. 1, horizontal strut 1*a* runs between the upper ends of the two vertical supports 1. The vertical supports 1 are positioned so that the front sides of the vertical supports face away from each other. The wide lower section of each vertical support 1 is arranged to be perpendicular to the horizontal strut. Strut 1*a* is preferably made of wood, and should be strong enough to allow a bench 7 supporting two or three adult humans to be suspended from it, as shown in FIG. 2. A chain 8, preferably a brass chain, is used to suspend the bench from the strut 1*a*.

Figure 3:
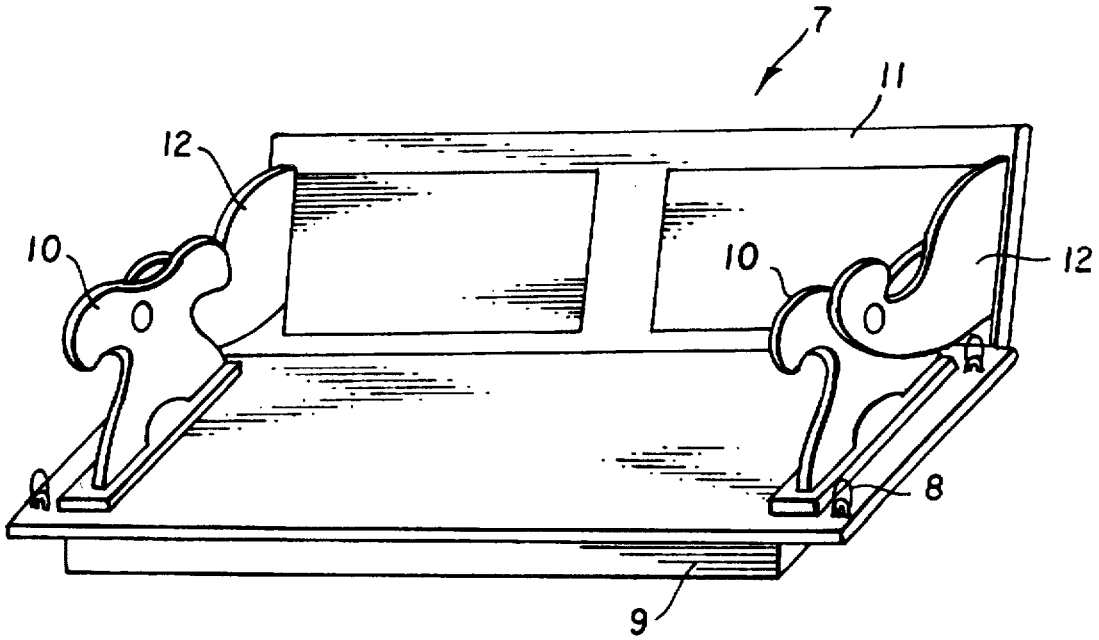
FIG. 3 illustrates a bench with a one-piece reversible back for use in the swing of FIG. 2.

Construction of the bench 7 is illustrated in FIG. 3. The bench comprises a generally horizontal rectangular support 9 and two vertical armrests 10. The armrests are rigidly mounted to opposite ends of support 9. A rectangular back 11 rests on one side of support 9. A bracket 12 having a hole therethrough is mounted rigidly to each end of back 11, and the back is connected to armrests 10 by driving pivot pins through the holes in brackets 12 and into the armrests 10. The direction faced by the seat may then be reversed by rotating brackets 12, and the seat back attached thereto, about the pivot pins. This has the effect of moving the seat back from one side of support 9 to the other. The elements used in making the bench is preferably made out of wood, although the seat back and the support 9 may be padded if desired. A horizontal shelf suitable for supporting writing paper, phone books, or similar implements may be mounted beneath support 9. Alternatively, a set of drawers may be mounted beneath support 9.

It is essential that the maximum length of the bench from the end to end be less than the length of the strut 1*a*. This allows the bench to be hung from strut 1*a* so that it swings freely, without impacting vertical supports 1. Preferably, the benches are designed to be long enough for two to three people to sit on them comfortably.

Figure 4:
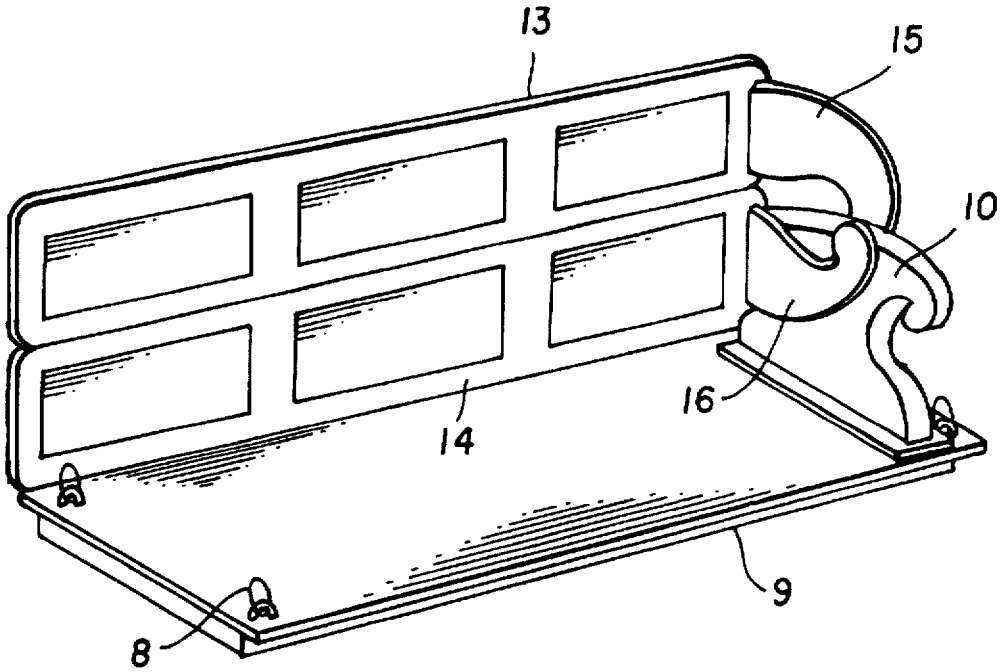
FIGS. 4 and 5 illustrate a bench with a two-piece reversible back for use in the swing of FIG. 2.
Figure 5:
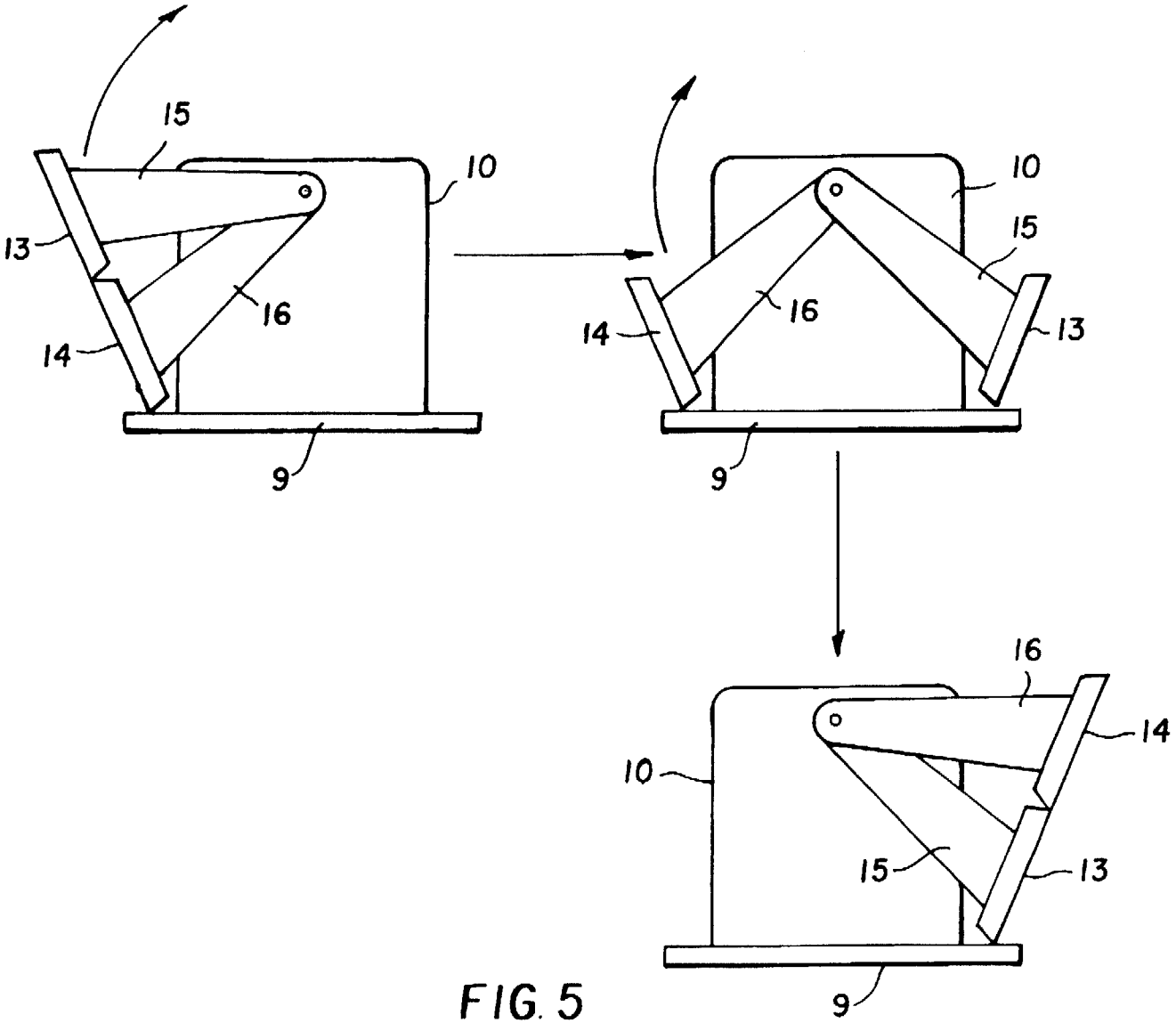

If desired, back 11 may be longitudinally divided into an upper back 13 and a lower back 14 (see FIG. 4). Upper back 13 has brackets 15 having holes therethrough rigidly mounted to its ends (for the sake of clarity, only one bracket 15 is shown in FIG. 4). Each bracket 15 is connected to one of armrests 10 by driving a pivot pin through the hole in bracket 15 into armrest 10. Upper back 13 may then be moved to the other side of support 9 by rotating brackets 15 about the pivot pins. The result is a cradle suspended from strut 1*a* having a bottom support 9. The cradle is enclosed on its ends by armrest 10, on one side by upper back 13, and on the other side by lower back 14. If desired, lower back 14 may be rigidly mounted to support 9. Alternatively, lower back 14 may be pivotably mounted to armrests 10 by means of a second bracket 16, in much the same way that upper back 13 was mounted to the armrests. In this case, a bench facing in a first direction can be converted to a crib by changing the position of the upper back 13, or to a bench facing in a second direction of changing the position of both upper back 13 and lower back 14 (see FIG. 5).

Figure 6:
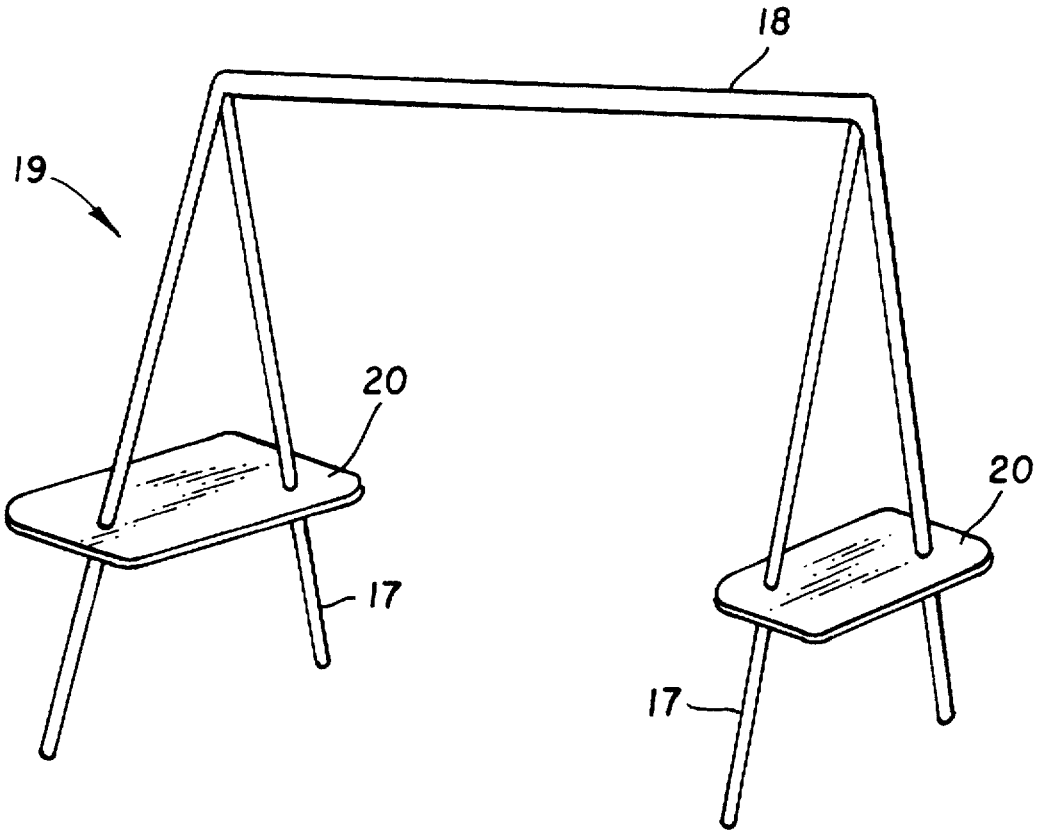
FIG. 6 illustrates a support framework for a second embodiment of the reversible swing described herein.

If desired, the support framework described above may be replaced by a support framework such as that shown in FIG. 6. This framework comprises four legs 17, and a horizontal strut 18. Each end of strut 18 is supported by a V-shaped structure 19 formed from two legs 17. A swinging bench or crib like those previously described is then suspended from strut 18. For added stability, the legs in each V-shaped structure may be joined by one or more horizontal braces 20. In a preferred embodiment, the braces have a horizontal planar surface which may be used as a shelf for supporting knick-knacks or other small objects.

Finally, the horizontal strut in the support framework may be used as a support for an overhead light fixture mounted about the crib or bench. Also, the horizontal strut may have a horizontal planar upper surface. In this case, the horizontal strut may be used to support a planter or similar article.

What is claimed is:

1. An article of furniture comprising:

a) a support frame comprising a first hollow vertical support having an upper end, a second hollow vertical support having an upper end, and a horizontal strut connecting the upper end of the first vertical support to the upper end of the second vertical support;

b) a bench comprising a horizontal support member, a plurality of arm rests mounted on said support member, a seat back, and a means for pivotably mounting said seat back to said plurality of arm rests; and c) a means for suspending the bench from the horizontal strut;

wherein the interior of at least one of the vertical supports is accessible through at least one door provided in said at least one of the vertical supports; and wherein (i) said first and second hollow vertical supports are adapted to support a first defined total weight of the horizontal strut, the bench suspended from the horizontal strut, and a plurality of adult humans or on the bench; and (ii) said horizontal strut is adapted to support a second defined total weight of said bench and said plurality of adult humans.

2. The article of furniture as defined in claim 1, wherein the interior of the first vertical support is accessible through a first door provided in the first vertical support, and the interior of the second vertical support is accessible through a second door provided in the second vertical support.

3. The article of furniture as defined in claim 1, wherein said at least one door is made out of solid wood.

4. The article of furniture as defined in claim 1, wherein said at least one door is constructed with a transparent panel made of glass or plastic.

5. The article of furniture as defined in claim 1, wherein shelves are provided in the vertical supports.

6. The article of furniture as defined in claim 1, wherein the seat back is longitudinally divided into (i) an upper back which is pivotably mounted by said first pivotable mounting means to said plurality of armrests, and (ii) a lower back which is rigidly mounted to said support member.

7. The article of furniture as defined in claim 6, wherein the bench is convertible to a crib by pivoting the upper back relative to said plurality of armrests.

8. The article of furniture as defined in claim 1, wherein the seat back is longitudinally divided into (i) an upper back which is pivotably mounted by said first pivotable mounting means to said plurality of armrests, and (ii) a lower back which is pivotably mounted to said plurality of armrests by a second means for pivotably mounting said lower back to said plurality of arm rests.

9. The article of furniture as defined in claim 8, wherein the bench is convertible to a crib by pivoting the upper back relative to said plurality of armrests.

10. The article of furniture as defined in claim 1, further comprising a horizontal shelf mounted beneath the horizontal support member.

11. The article of furniture as defined in claim 1, further comprising one or more drawers slidably mounted beneath the horizontal support member.

12. The article of furniture as defined in claim 1, wherein the first vertical support and the second vertical support each comprise an upper support mounted on a lower support, said lower support having a greater width than said upper support.

13. The article of furniture as defined in claim 12, wherein the depth of the lower support is substantially identical to the depth of the upper support.

* * * * *

UNITED STATES PATENT AND TRADEMARK OFFICE

CERTIFICATE OF CORRECTION

PATENT NO. : 5,749,623

DATED : May 12, 1998

INVENTOR(S) : Thakor R. Mistry and Jyotsua T. Mistry

It is certified that error appears in the above-indentified patent and that said Letters Patent is hereby corrected as shown below:

On the title page, in the Attorney, Agent, or Firm section, delete "Devani" and insert –Devnani--.

Signed and Sealed this

Seventh Day of July, 1998

Bruce Lehman

*Attest:*

BRUCE LEHMAN

*Attesting Officer*

*Commissioner of Patents and Trademarks*